US006786461B1

(12) United States Patent
Tsai et al.

(10) Patent No.: US 6,786,461 B1
(45) Date of Patent: Sep. 7, 2004

(54) COMPUTER ARMREST

(75) Inventors: Hong-Tai Tsai, Tainan (TW); Hui-Ping Chou, Tainan (TW)

(73) Assignee: Horng Sheng Lih Enterprise Co., Ltd., Tainan (TW)

( * ) Notice: Subject to any disclaimer, the term of this patent is extended or adjusted under 35 U.S.C. 154(b) by 0 days.

(21) Appl. No.: 10/633,478

(22) Filed: Jul. 30, 2003

(51) Int. Cl.[7] ..... B43L 15/00

(52) U.S. Cl. ..... 248/118.3; 248/278.1; 248/918; 248/292.12

(58) Field of Search ..... 248/118, 118.1, 248/118.3, 118.5, 278.1, 284.1, 292.12, 918; 297/411.23, 411.35

(56) References Cited

U.S. PATENT DOCUMENTS 1,266,367 A * 5/1918 Wilson ..... 5/646
3,193,674 A * 7/1965 Fleming ..... 362/430
4,562,987 A * 1/1986 Leeds et al. ..... 248/278.1
4,592,526 A * 6/1986 Kobelt ..... 248/284.1
5,074,501 A * 12/1991 Holtta ..... 248/118.3
5,964,439 A * 10/1999 Johnson ..... 248/278.1
5,975,469 A * 11/1999 Chen ..... 248/118.1
6,086,034 A * 7/2000 McAllister et al. ..... 248/278.1
6,112,449 A * 9/2000 Blackwell ..... 43/21.2
D438,725 S * 3/2001 Takahashi ..... D6/418
6,347,771 B1 * 2/2002 Lauzon et al. ..... 248/118
6,688,563 B1 * 2/2004 Waxham et al. ..... 248/118.1

FOREIGN PATENT DOCUMENTS

SE WO-91/14384 * 10/1991

* cited by examiner

*Primary Examiner*—Leslie A. Braun
*Assistant Examiner*—Jon Szumny

(57) ABSTRACT

A computer armrest includes an elbow supporter, a mouse pad and a connect arm. The elbow supporter and the mouse pad are movably connected with the connect arm so as to freely turn with the position of the elbow or the palm. The elbow supporter can be adjusted more than 90 degrees by means of the connect arm and also bent downward to be collapsed under a computer table not to lake any space on the table in case of not using.

1 Claim, 4 Drawing Sheets

COMPUTER ARMREST

FIELD OF THE INVENTION

This invention relates to a computer armrest, particularly to one preventing a computer-using worker from getting occupational harm.

BACKGROUND OF THE INVENTION

As for equipment for preventing computer-using workers from preventing them from occupational harm, a U.S. Pat. No. 5,074,501 disclosed an elbow supporter for workers using computers to rest the elbow thereon, using two always-parallel arms for adjusting the horizontal height of the elbow supporter so that a user can place the elbow stably and comfortably thereon. This elbow supporter is designed to have an objective and function of horizontal adjustment and tight fixing with a computer table for the elbow supporter. But it only has a bolt for adjusting the two parallel arms so the adjustable angle and the horizontal position are quite limited, impossible to collapse it under the table when not used.

And another U.S. Pat. No. 4,592,526 disclosed one, which has two arms combined vertically, with one at the upper and the other at the lower, and corresponding toothed surfaces at the joint, with an disadvantage that each arm can only swing right and left in adjusting the position of the two arms. Therefore, it is limited in its use, very inconvenient.

SUMMARY OF THE INVENTION

The objective of the invention is to offer a computer armrest possible to prevent a computer using worker from getting occupational harm, and easy to collapsing it under a computer table, not taking any space on the table when not used.

One of the feature of the invention is an elbow supporter held by a connect arm and moving freely together with the elbow of a user, letting the elbow and the arm held naturally.

The other objective of the invention is to offer a computer armrest having the connect arm with its two ends each provided with an adjusting bolt permitting the elbow supporter adjusted in multi-directions and its height.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
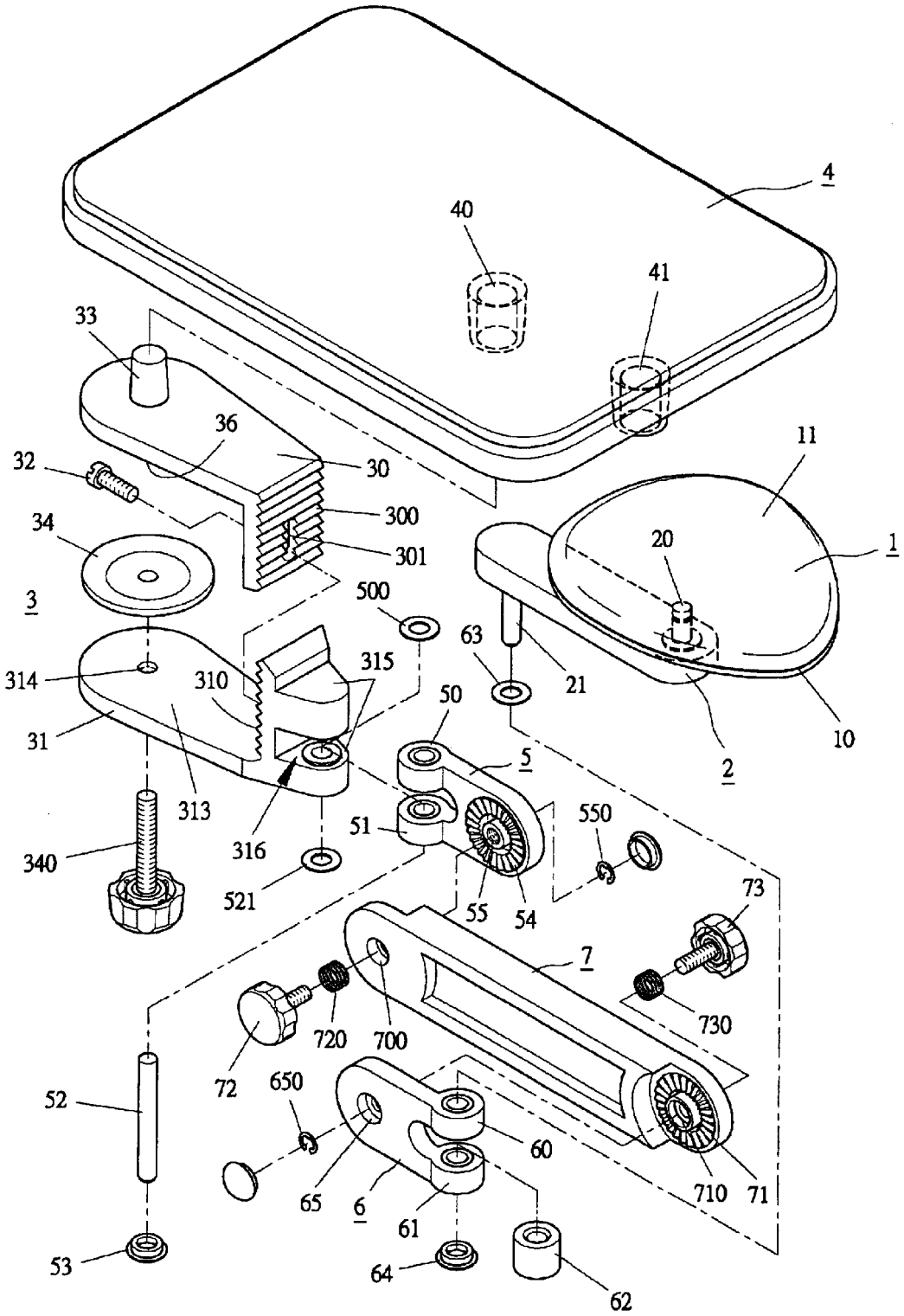
FIG. 1 is an exploded perspective view of a computer armrest in the present invention.

A preferred embodiment of a computer armrest in the present invention, as shown in FIG. 1, includes an elbow supporter 1, an upper arm 2, a pinch base 3, a mouse pad 4, a front turning base 5, a rear turning base 6, a connect arm 7 as main components combined together.

The elbow supporter 1 has a convex upper surface 10 to match with ergonomics, a soft pad 11 laid on the upper surface 10, and fitted through by a first shaft 20 of the upper arm 2 to turn around freely.

The upper arm 20 has the first shaft 20 to fit in the elbow supporter 1 to let the elbow supporter move freely, and a second shaft 21 extending downward to combine with the rear turning base 6.

Figure 2:
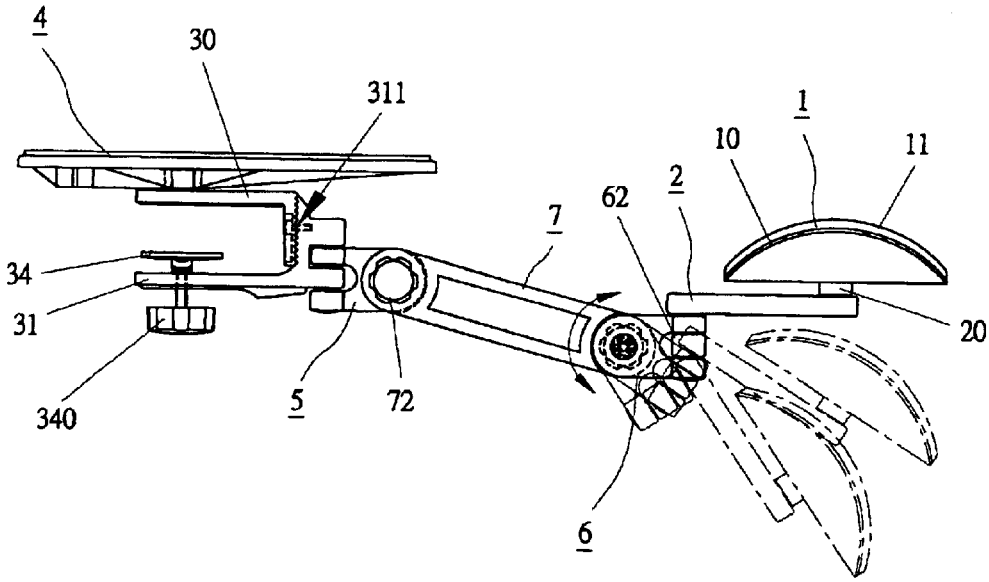
FIG. 2 is a side view of a first stage of movement of the computer armrest in the present invention.
Figure 3:
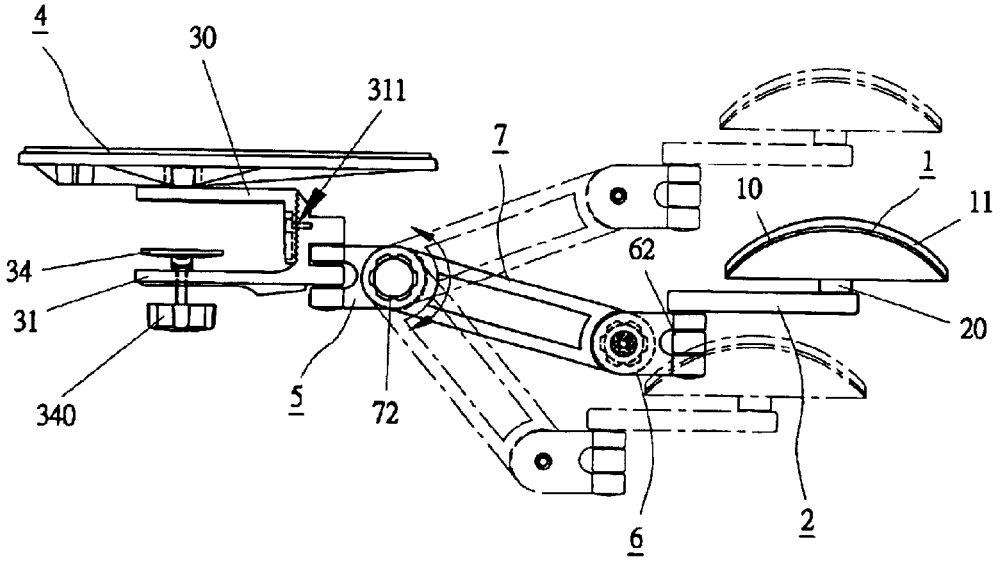
FIG. 3 is a side view of a second stage of movemtn of the computer armrest in the present invention.
Figure 4:
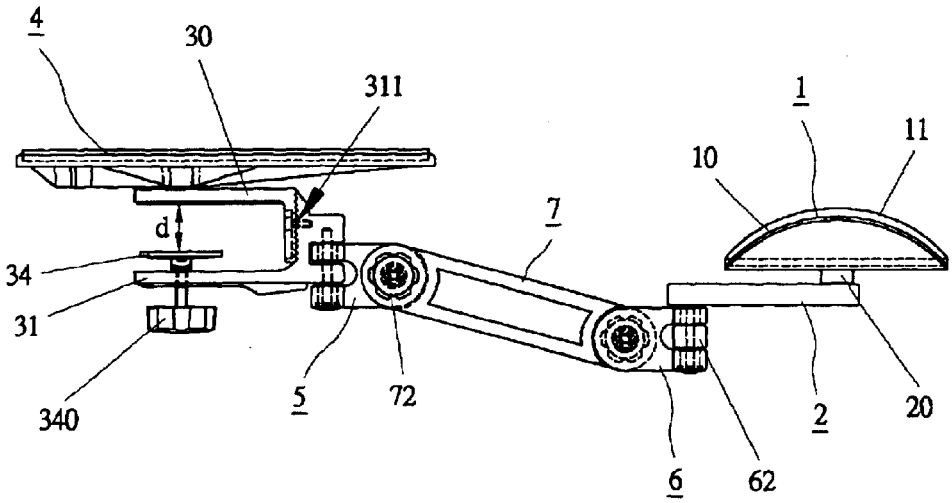
FIG. 4 is a side view of the computer armrest in the present invention.
Figure 5:
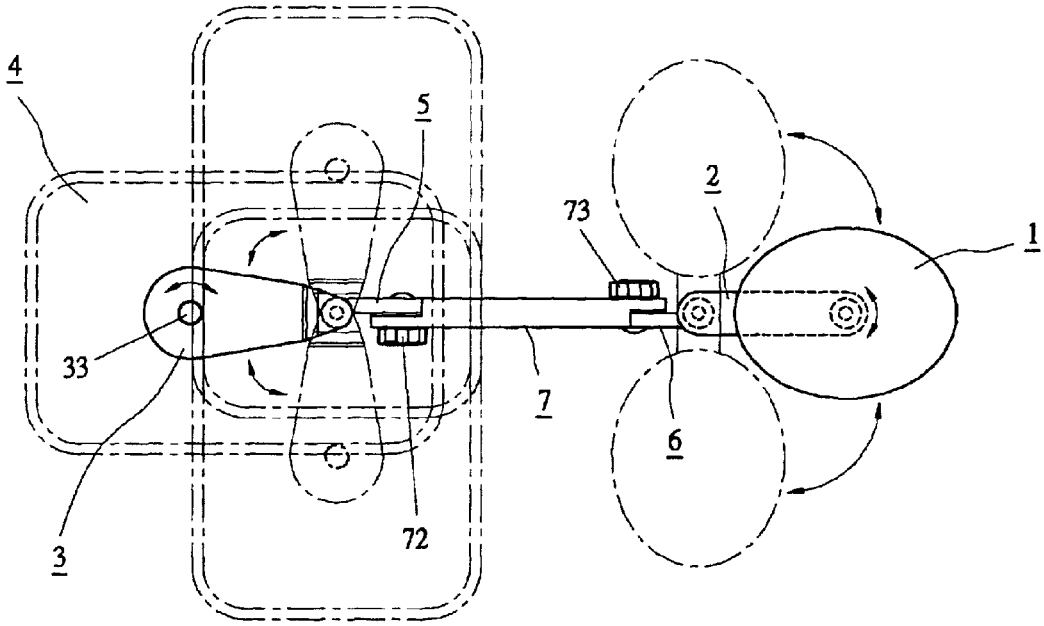
FIG. 5 is an upper view the computer armrest in moving condition in the present invention.

The pinch base 3 consists of an upper pinch base 30 and a lower pinch base 31, and the upper and the lower pinch base 30, 31 have respectively a vertical circular toothed surface 300 and 310 to engage with each other for adjustment. The upper and the lower pinch base 30 and 31 further respectively have a vertical slot 301 and a threaded hole 311, as shown in FIGS. 2 and 3, for a bolt 32 to fit through and screw with to adjust the combined height of the two half bases 30 and 31 so as to change the height of the mouse pad 4. The upper pinch base 30 further has a shaft 33 fixed on an upper surface to fit in either of two shaft holes 40 and 41 of the mouse pad 4, permitting the mouse pad 4 turn freely as shown in FIGS. 4 and 5. The lower pinch base 31 has an upper surface 313 and a threaded hole 314 in the upper surface 313 for a bolt 340 of the pinch plate 34 to screw with so as to adjust the distance between the surface of the pinch plate 34 and a pinch surface 36 of the upper pinch base 30 according to the thickness of the object to be sandwiched for effectuating stable pinching. The lower pinch base 31 further has a turning shaft base 315 with an opening 316 in a rear portion for combining with the front turning base 5.

The front turning base 5 has two shaft bases 50, 51 with an intermediate opening between them, with the shaft base 50 inserting in the opening 316 and with the lower shaft base 51 positioning under the shaft turning base 315. Then a shaft 52 extends through the lower shaft base 51, the turning shaft base 315 and the turning shaft base 50 from under, and then closed with a shaft cap 53 with two washers 500, 521 to combine the front turning base 5 stably. The front turning base 5 further has a vertical circular toothed surface 54 formed in an inner wall and a threaded hole 55 in the toothed surface 54.

The rear turning base 6 has two shaft bases 60, 61 respectively with a center hole for the shaft 21 of the connect arm 2 to fit therein and also pass though a gasket 62 and a washer 63, and then closed with a shaft cap 64 so as to position the rear turning base 6 stably. The rear turning base 6 further has a vertical circular toothed surface 66 and a threaded hole 65 in the toothed surface 66.

Figure 6:
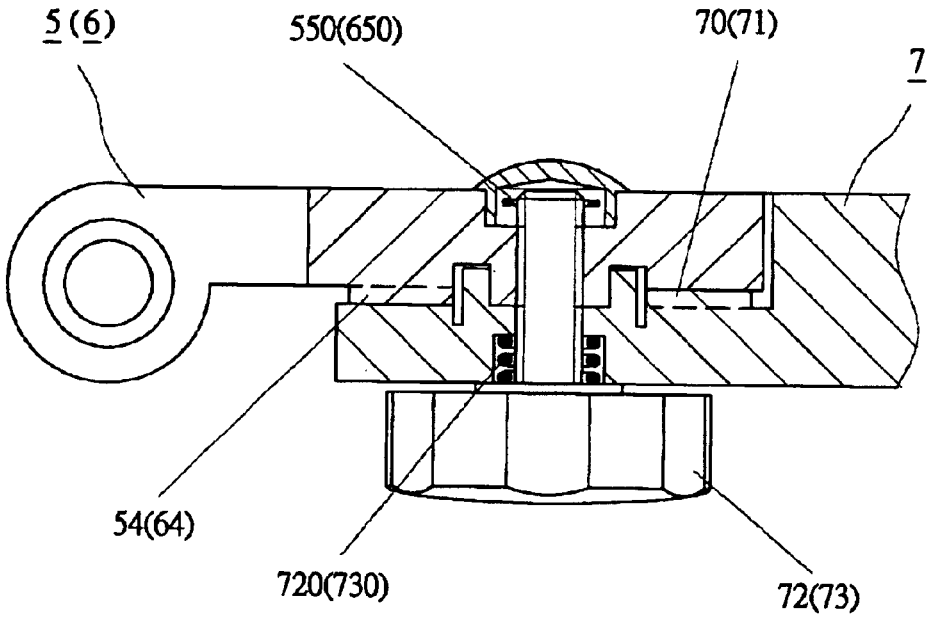
FIG. 6 is a cross-sectional view of an adjusting bolt in a first adjusting condition in the present invention; and, FIG. 7 is a cross-sectional view of an adjusting bolt in a second adjusting condition in the present invention.
Figure 7:
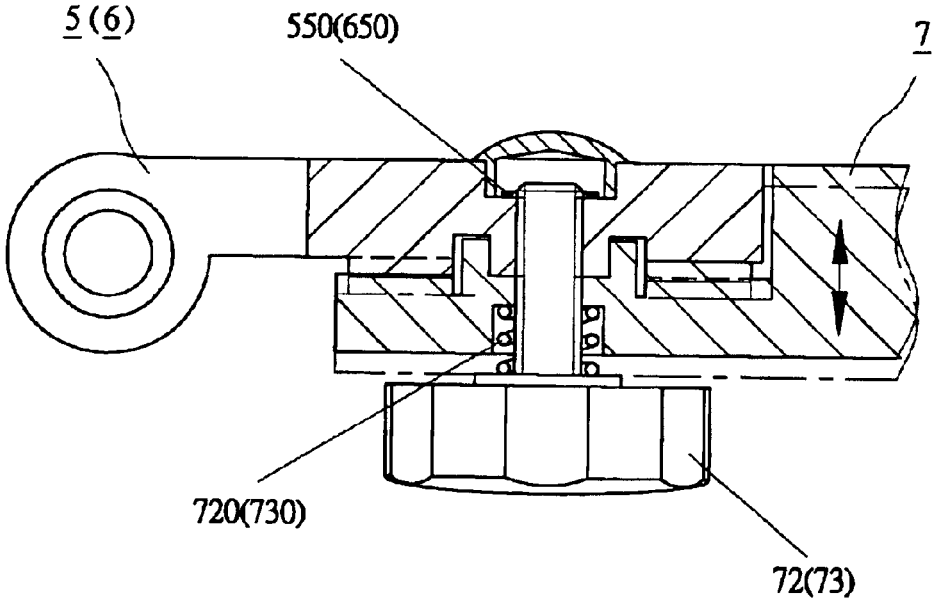

The connect arm 7 has a front vertical circular toothed surface 70 and a rear vertical circular toothed surface 71 to engage respectively with the toothed surfaces 54 and 66 of the upper and the lower turning base 5 and 6, and a threaded hole 700 and 710 as shown in FIGS. 6 and 7 for an adjusting bolt 72 and 73 to fit through a spring 720 and 730, then screw with the threaded holes 55, 65 and then are locked by helical spring lock washers 550 and 650, combining the connect arm 7 movably with the front and the rear turning base 5 and 6, and limiting the looseness and tightness of the adjusting bolts 72 and 73. Changing only the combining position of the connect arm 7 with the front and the rear turning base 5 and 6 can change the position of the elbow supporter 1 to correspond with the elbow of a user. Further, the elbow supporter 1 can be collapsed under a computer table not to take the space on the table.

Further, the two adjusting bolts 72, 73 of the connect arm 7 enable the height of the elbow supporter to be adjusted and the horizontal position also to be adjusted, in accordance with the habit of a user, the height of the key board, and the need of a user to get comfort in using a computer.

While the preferred embodiment of the invention has been described above, it will be recognized and understood that various modifications may be made and the appended claims are intended to cover all such modifications that may fall within the spirit and scope of the invention.

What is claimed is:

1. A computer armrest comprising:

an elbow supporter combined pivotally with a first shaft of an upper arm to turn freely;

said upper arm having said first shaft extending upward at a right side and also a second shaft extending downward at a left side;

a pinch base consisting of an upper pinch base and a lower pinch base, said upper and said lower pinch base each respectively having a vertical toothed surface formed on a vertical side facing each other to engage with each other for adjusting, either of said upper and said lower pinch base having a threaded hole or a vertical slot for an adjusting bolt to fit through and screw with, said upper pinch base having a left shaft fitting in either of two shaft holes of a mouse pad, said lower pinch base having a threaded hole in its left side for a bolt of a pinch plate to screw with so as to adjust the distance between the upper surface of said pinch plate and a lower surface of said upper pinch base, said lower pinch base further having a turning shaft base at a rear side, said turning shaft base having a intermediate opening for a front turning base to fit therein;

said front turning base having a shaft base formed in a left portion, said shaft base fitting in the intermediate opening of said lower pinch base, a shaft fitting vertically through said turning shaft base of said lower pinch base and said shaft base of said front turning base from under, a shaft cap closing said shaft with a washer at the lower side of said front turning base so that said front turning base may be combined with said lower pinch base stably, said front turning base further having a vertical circular toothed surface with a center threaded hole;

a rear turning base having a shaft base formed in a right portion for said second shaft of said upper arm to extend through with a ring gasket and a washer, a shaft cap closing said shaft at a lower side of said shaft base, said rear turning base further having a vertical circular toothed surface with a center threaded hole;

a connect arm having a front end and a rear end respectively provided with a vertical circular toothed surface with a center threaded hole, an adjusting bolt fitting through a spring and then engaging with said threaded holes of said front and said rear turning base and said connect arm and locked with a helical spring lock washer so that said connect arm may be combined with said front and said rear turning base stably; and, the combined position of said connect arm with said front and said rear turning base can be moved freely and accordingly said elbow supporter possible to be moved freely thereby.

* * * * *